US006330408B1

(12) United States Patent
Wakahara et al.

(10) Patent No.: US 6,330,408 B1
(45) Date of Patent: Dec. 11, 2001

(54) TRANSFER APPARATUS

(75) Inventors: Shirou Wakahara, Sakura; Tomohiro Oikawa, Chiba; Yukikazu Kamei, Ichihara; Hideki Ohnishi; Hiroshi Doshoda, both of Chiba, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/428,334

(22) Filed: Oct. 27, 1999

(30) Foreign Application Priority Data

Oct. 28, 1998 (JP) ..... 10-306553

(51) Int. Cl.[7] ..... G03G 15/16
(52) U.S. Cl. ..... 399/66; 399/314
(58) Field of Search ..... 399/296, 66, 314, 399/297, 298, 313

(56) References Cited

U.S. PATENT DOCUMENTS

| | | | |
|---|---|---|---|
| 5,010,370 | | 4/1991 | Araya et al. . |
| 5,189,478 | * | 2/1993 | Hara et al. . |
| 5,351,113 | * | 9/1994 | Pietrowski et al. . |
| 5,371,579 | * | 12/1994 | Bisaiji . |
| 5,450,180 | * | 9/1995 | Ohzeki et al. . |
| 5,729,810 | * | 3/1998 | Bergen et al. . |
| 5,799,225 | | 8/1998 | Abe et al. . |
| 5,907,740 | * | 5/1999 | Nozawa . |
| 5,987,292 | | 11/1999 | Ohnishi . |
| 6,026,256 | | 2/2000 | Abe et al. . |

FOREIGN PATENT DOCUMENTS

| | | | |
|---|---|---|---|
| 0367157 | * | 5/1990 | (EP) . |
| 56-104340 | * | 8/1981 | (JP) . |
| 6-202429 | * | 7/1994 | (JP) . |
| 8240937 | | 9/1995 | (JP) . |
| 8-240937 | | 9/1996 | (JP) . |
| B22733609 | | 1/1998 | (JP) . |
| 10-123801 | * | 5/1998 | (JP) . |

* cited by examiner

*Primary Examiner*—Robert Beatty

(57) ABSTRACT

A transfer apparatus having a photoconductor drum for holding thereon an image formed by toner charged with a negative polarity and a transfer roller disposed opposite the photoconductor drum, in which paper is fed to an area where the photoconductor drum and the transfer roller face each other and the toner image on the photoconductor drum is transferred to the paper by using a unidirectional transfer electric field formed by the transfer roller. The transfer roller also serves as charge supply control device for supplying a charge to the toner held on the photoconductor drum to thereby substantially neutralize the charge of the toner while retaining the negative polarity of the toner.

11 Claims, 6 Drawing Sheets

TRANSFER APPARATUS

BACKGROUND OF THE INVENTION

1. Field of the Invention

The present invention relates to a transfer apparatus having an image carrier for holding thereon an image formed by a developer charged with a prescribed polarity and transfer means disposed opposite the image carrier, wherein a recording medium is fed to an area where the image carrier and the transfer means oppose to each other, and the developer image on the image carrier is transferred the recording medium by using a transfer electric field formed by the transfer means. The invention is applicable to print sections in digital copiers and facsimile machines as well as to digital printers, plotters, and the like.

2. Description of the Related Art

As an image forming apparatus for outputting an image signal onto a recording medium such as paper in the form of a visible image, Japanese Examined Patent Publication JP-B2 2733609, for example, discloses an image forming apparatus that forms an image by transferring a developer image (toner image) on an image carrier (photoconductor drum) to a recording medium using a transfer roller.

In such an image forming apparatus as exemplified by the above prior art, a toner image developed on a photoconductor drum is transferred to a recording medium, i.e., paper surface, by pressing an elastic transfer roller having a medium to high resistance in contacting relationship to the paper. Such contact transfer techniques have the excellent characteristics of being able to produce images of good quality without generating ozone during the process.

In such image forming apparatus, when transferring the toner image developed on the photoconductor drum, a transfer electric field is formed by applying a transfer voltage to the transfer roller. Especially, according to the prior art, a good transfer is achieved by specifying the amounts of charge to be supplied to toner-image areas and non-toner-image areas when transferring the toner image from the photoconductor drum.

With this arrangement, however, it may become difficult to transfer the toner image securely to the paper, depending on the condition of the toner.

For example, when the amount of charge of the toner used is very small and the amount of toner adhering to the photoconductor drum is also very small, reverse transfer may occur and good transfer may not be obtained, thus resulting in a transfer failure. If this happens, various troubles occur, such as an insufficient density or a dropout in a solidly shaded area, the inability to reproduce the desired halftone because of a transfer failure of a screened halftone image, and in the case of a color image forming apparatus, difficulty in reproducing the correct color.

Further, if the transfer is to be performed without neutralizing the charge the toner has, it is required to form a transfer electric field strong enough to overcome the image force being exerted by the charge the toner has, and in this case, an extremely large transfer electric field becomes necessary.

If such a large electric field is formed, since the amount of charge of the toner held to the photoconductor drum is not constant but varies across the surface of the drum, toner particles with smaller charge amounts are easily attracted by the charge and scattered onto the paper on the upstream side of transfer area, causing image degradation.

SUMMARY OF THE INVENTION

The present invention has been devised in view of the above-outlined problems, and provides a transfer apparatus comprising an image carrier for holding thereon an image formed by a developer charged with a prescribed polarity and transfer means disposed opposite the image carrier,a recording medium being fed to an area where the image carrier and the transfer means face each other, and a developer image on the image carrier being transferred to the recording medium by using a transfer electric field formed by the transfer means, wherein the transfer apparatus is provided with supply means for supplying a charge to the developer held on the image carrier and thereby substantially neutralizing the charge of the developer while retaining the prescribed polarity.

According to the invention, since the developer held on the image carrier is transferred by substantially neutralizing the charge the developer has while retaining the prescribed polarity, the image force of the developer on the image carrier can be reduced, thus making it easier to transfer the developer to the recording medium by the transfer electric field; as a result, the use of a transfer electric field can be reduced to prevent the scattering of the developer onto the recording medium on the upstream side of the transfer area, and it is possible to reduce the size and the number of components of the power supply unit used to produce the transfer electric field.

The invention also provides a transfer apparatus comprising an image carrier for holding thereon an image formed by developers of a plurality of colors charged with a prescribed polarity and transfer means disposed opposite the image carrier, in which a recording medium is fed to an area of the image carrier which faces the transfer means, to transfer a developer image on the image carrier to the recording medium using a transfer electric field formed by the transfer means, wherein the transfer apparatus is provided with charge supply means for supplying charge appropriate to each color developer held on the image carrier and thereby substantially neutralizing the charge of the developer while retaining the prescribed polarity.

According to the invention, since the developers of the respective colors held on the image carrier are transferred by substantially neutralizing the charge of each color developer while retaining the prescribed polarity, the image force of each color developer on the image carrier can be reduced according to the characteristics of the developer, thus making it easier to transfer each color developer to the recording medium by the transfer electric field; as a result, the use of a transfer electric field can be reduced to prevent the scattering of the developer onto the recording medium on the upstream side of the transfer area, and it is possible to reduce the size and number of components of the power supply unit used to produce the transfer electric field.

In the invention it is preferable that the charge supply means is implemented in common with the transfer means.

Since the charge supply means of the invention is implemented in common with the transfer means, there is no need to provide a separate charge supply means and the number of components can thus be reduced.

In the invention it is preferable that in transfer the charge supply means supply a smaller amount of charge of reverse polarity than the amount of charge held by the developer on the image carrier to substantially neutralize the charge of the developer while maintaining the prescribed polarity of the developer.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
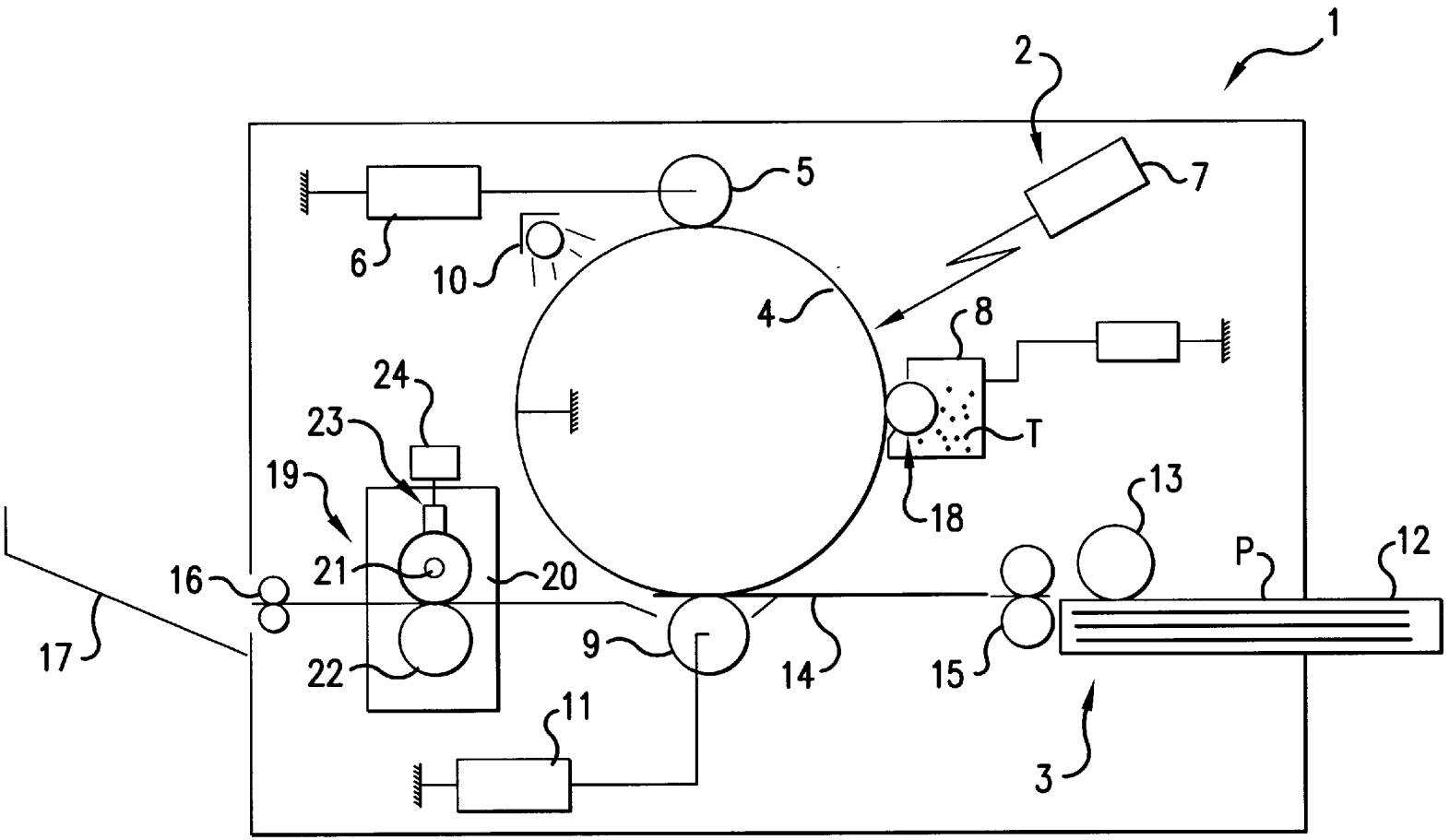
FIG. 1 is an explanatory diagram showing schematically a first embodiment concerning a monochrome image forming apparatus using the transfer apparatus of the present invention.

Now referring to the drawings, preferred embodiments of the invention are described below.

A first embodiment of an image forming apparatus using a transfer apparatus of the invention will be described with reference to drawing. Various methods, such as the Carlson process and ion flow process, can be used in the image forming apparatus for the image formation on an image carrier necessary for recording an image on a recording medium. The first embodiment described herein deals with an image forming apparatus using the Carlson process.

FIG. 1 is a diagrammatic cross sectional view of the image forming apparatus using the transfer apparatus of the invention. This image forming apparatus is used as an output device for a computer, but it can also be adapted for use as a word processor a printing unit of a facsimile machine, or printing unit of a digital copier.

A main body 1 of the image forming apparatus shown in FIG. 1 contains an image forming section 2 for forming an image and a paper feed device 3 for feeding paper P, a recording medium, into the image forming section 2.

The image forming section 2 comprises: a photoconductor drum 4 which is an image carrier with a photoconductive layer formed on an aluminum drum; a charge roller 5 which applies a uniform charge to the surface of the photoconductor drum 4; a charge power supply 6 which applies a voltage to the charge roller 5; a laser unit 7 which projects a laser beam to the charged surface of the photoconductor drum 4 for exposure in accordance with image data; a developing device 8 for forming a toner image by applying toner T, the developer, to an electrostatic latent image formed as a charge pattern by the exposure; a transfer roller 9 for transferring the toner image formed on the photoconductor drum 4 to the paper P by pressing the paper P against the photoconductor drum 4; and a charge eliminating lamp 10 for removing any residual charge on the photoconductor drum 4.

During the transfer, the transfer power supply 11 applies a transfer voltage of 1.3 kV to the transfer roller 9. The paper feed device 3 comprises: a cassette 12 for holding paper P therein; a pickup roller 13 for feeding the paper P out of the cassette 12; a paper feed guide 14 for guiding the thus fed paper P; and a pair of resist rollers 15 for transporting the thus fed paper P at a prescribed speed.

The paper feed device 3 further includes a paper feed sensor (not shown) for detecting the feeding of the paper P.

The rollers, including the pickup roller 13, and the photoconductor drum 4 are driven for rotation by a driving mechanism not shown. These rotating members are controlled by appropriately timing their rotations using a process control unit not shown.

On the paper exit side of the image forming apparatus are disposed paper exit rollers 16 and a paper exit tray 17 for holding the ejected paper P.

The charge roller 5 is formed from a solid rubber using, for example, urethane as the base material, and exhibits a resistance value of $1\times10^5$ Ω·cm. This charge roller 5 applies an electrical potential to the photoconductor drum 4 grounded with the charge power supply 6 so that the surface potential of the photoconductor drum 4 becomes −600 V.

Likewise, the transfer roller 9 is formed from a foam rubber layer of JIS-A30° using urethane as the base material, like the charge roller 5.

The charge eliminating lamp 10 consists of a plurality of LEDs, and is used to project light to the surface of the photoconductor drum 4 and to neutralize and eliminate any residual charge on the surface of the photoconductor drum 4.

Most of the above component parts can be constructed using, for example, corresponding parts of a laser printer.

Next, the operation of the image forming apparatus of FIG. 1 will be described.

When a print operation cycle is started in response to a print command from a host computer not shown, first the pickup roller 13 removes one sheet of paper P from the paper feed cassette 12, and advances the paper P to the resist rollers 15. The resist rollers 15 feed the paper P at a prescribed speed into the area where the photoconductor drum 4 and the transfer roller 9 oppose each other.

In synchronization with this operation, the charge power supply 6 supplies a voltage of, for example, about −1200 V to the charge roller 5 which then supplies an electrical charge so that a surface potential of about −600 V is given to the surface of the photoconductor drum 4.

In this condition, as the charged surface of the rotating photoconductor drum 4 is brought to the area opposite the laser unit 7, the laser unit 7 illuminates the charged surface of the photoconductor drum 4 with a laser pulse corresponding to the desired image data. The area on the photoconductor drum 4 exposed to the laser now has reduced resistance because of its photo conductivity, so that the charge applied to the surface is neutralized and the surface potential drops, thus forming a pattern of electrostatic charge (hereinafter called the electrostatic latent image) on the surface of the photoconductor drum 4. This electrostatic latent image is brought to the area opposite the developing device 8 with the rotation of the photoconductor drum 4.

The developing device 8 contains toner T and includes a sleeve 18 that confers prescribed properties on the toner T. The developing device 8 applies the toner T to develop the electrostatic image into a toner image Ta (see FIG. 5). When the toner image Ta reaches the area opposite the transfer roller 9 with the further rotation of the photoconductor drum 4, the toner image Ta contacts the paper P fed into the same area, and the toner image Ta formed on the photoconductor drum 4 is transferred to the paper P, thus forming the image on the paper P.

After that, the paper P is transported to a fixing section 19 where the toner image is permanently fixed to the paper P; thereafter, when the paper P reaches the paper exit rollers 16, the paper exit rollers 16 transports the paper P out onto the paper exit tray 17.

On the other hand, the electrostatic latent image on the photoconductor drum 4 that passed the area opposite the transfer roller 9 now reaches the area opposite the charge eliminating lamp 10 which illuminates charge eliminating light across the entire length of the photoconductor drum 4 passing the same area and thus neutralizes the charges forming the electrostatic image.

The image forming apparatus of FIG. 1 uses a laser unit as the exposure means for forming the electrostatic latent image, but the exposure means need not be limited to this particular device; for example, an LED head consisting of a plurality of LEDs may be used. The exposure means may be constructed to produce exposure light in accordance, for example, with an image signal supplied from a computer or from an image processing section of a digital copier, as described above; alternatively, the exposure means may be constructed as an exposure device, for example, for use in an analog copier, and capable of illuminating an original document and using the reflected light from it for exposure.

The fixing section 19 comprises a heating roller 20, a heater 21, a pressure roller 22, a temperature sensor 23, and a temperature control circuit 24.

The heating roller 20 is constructed, for example, from an aluminum pipe of 2 mm in thickness. The heater 21 is constructed using, for example, a halogen lamp, and is contained inside the heating roller 20. The pressure roller 22 is formed, for example, from a silicone resin. The heating roller 20 and pressure roller 22 disposed opposite each other are pressed together, for example, with a load of 2 kg by means of springs or the like (not shown) disposed at both ends of their shafts so that the paper P can be pressed between them. The temperature sensor 23 measures the surface temperature of the heating roller 20. The temperature control circuit 24 is controlled by a main control unit, and holds the surface temperature of the heating roller 20, for example, at 150° C. by controlling the ON/OFF operation, etc. of the heater 21 based on the result of the measurement from the temperature sensor 23.

The fixing section 19 further includes a paper exit sensor (not shown) for detecting the ejection of the paper P.

The materials for the heating roller 20, the heater 21, the pressure roller 22, etc. are not specifically limited. Further, the temperature at which the surface of the heating roller 20 is to be controlled is not limited to any particular temperature. The fixing section 19 is constructed to fix toner images to paper P, such as plain paper or OHP film, by heating or by pressure.

Next, transfer control operation in the thus constructed image forming apparatus will be described.

In the first example, toner T having an amount of charge of −10 $\mu$c/g is applied at a rate of 1 mg/cm$^2$ to the photoconductor drum 4 for development. When transferring the toner image Ta from the photoconductor drum 4 to the paper P, the smaller the charge amount (charge level) of the toner T the better. The toner T on the photoconductor drum 4 is acted upon not only by an electric force exerted in the direction of the paper P due to the transfer electric field formed by the transfer roller 9, but also by an image force on the photoconductor drum 4.

Here, the electric force associated with the transfer electric field is proportional to the charge amount of the toner T, and the image force is proportional to the square of the charge amount; therefore, in order to produce favorable conditions for the transfer and enhance the transfer efficiency by reducing the influence of the image force and increasing the contribution of the electric force associated with the transfer field, the amount of charge the toner T has must be reduced. The simplest way to reduce the amount of charge the toner T has is to inject a charge of opposite polarity to that of the toner T into the toner T. Fortunately, a voltage opposite in polarity to the charge possessed by the toner T is supplied from the transfer power supply 11 to the transfer roller 9 for transferring the toner T to the paper P; as a result, the opposite charge is supplied to the toner T. However, if the amount of charge supplied is too large, the charge polarity of the toner T is reversed from the desired charge polarity; if this happens, a transfer failure occurs because the toner T is not transferred when the transfer voltage is applied to the transfer roller 9. On the other hand, if the amount of charge of the toner T is reduced exactly to zero, the transfer becomes difficult. Accordingly, to achieve a good transfer, the amount of charge that the toner T has must be maintained slightly greater than zero during the transfer.

Figure 2:
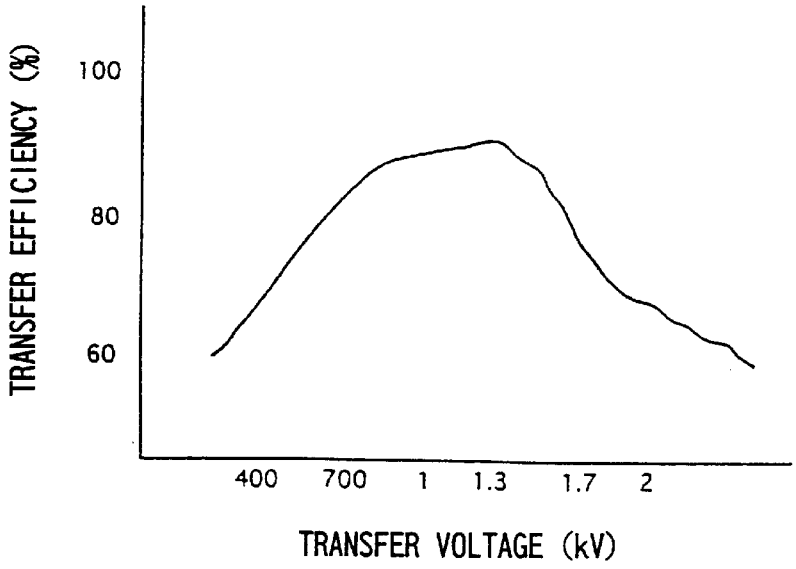
FIG. 2 is a characteristic diagram showing how transfer efficiency changes when transfer voltage is varied in the image forming apparatus according to the first embodiment of the invention.
Figure 3:
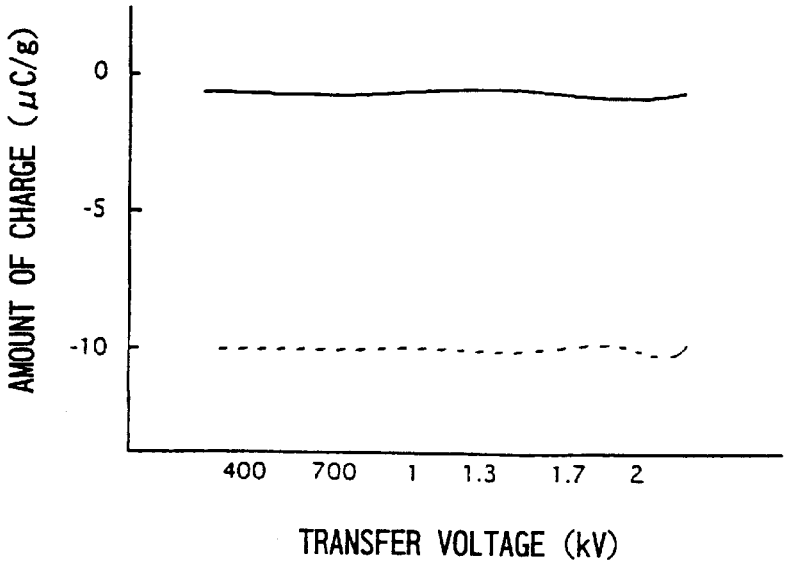
FIG. 3 is a characteristic diagram showing the amount of charge of toner before transfer as a function of the transfer voltage in the image forming apparatus according to the first embodiment of the invention.
Figure 4:
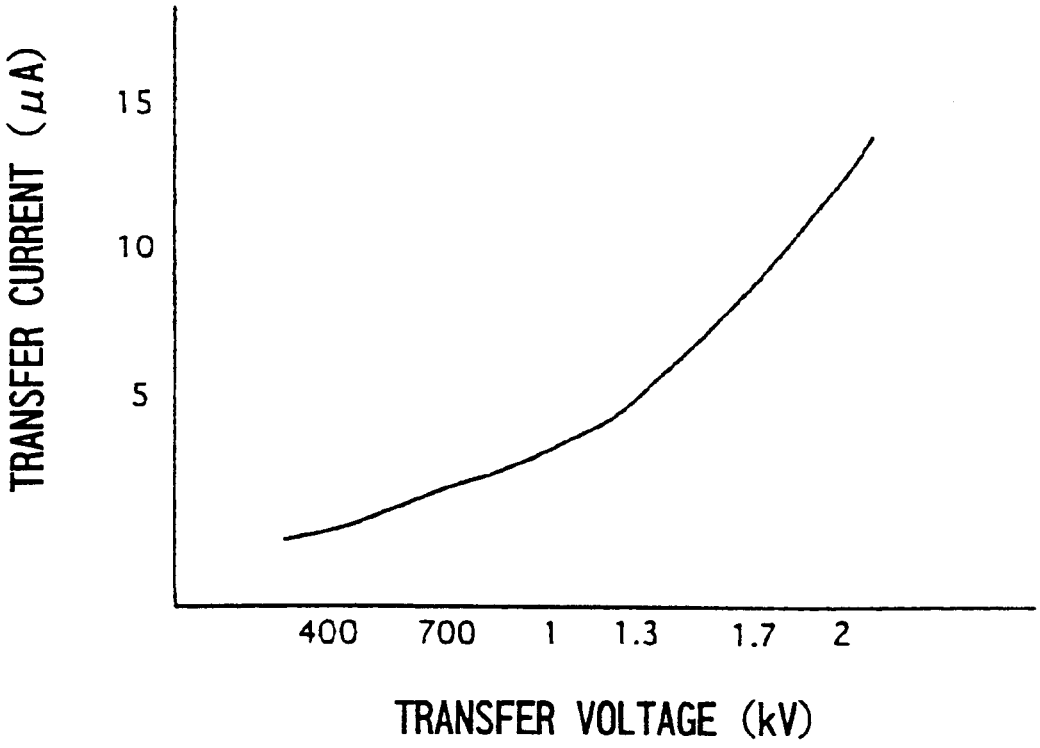
FIG. 4 is a characteristic diagram showing how transfer current changes when transfer voltage is varied in the image forming apparatus according to the first embodiment of the invention.

This will be explained with reference to FIGS. 2 to 4. FIG. 2 shows the transfer efficiency when the transfer voltage is varied in the first embodiment. FIG. 3 shows the amount of charge of the toner T transferred to the paper P for the case of FIG. 2. The dashed line in FIG. 3 shows the amount of charge of the toner T held on the photoconductor drum 4 before the transfer, while the solid line represents the amount of charge of the toner T transferred to the paper P. FIG. 4 shows the transfer current at this time. It is thus shown that the toner T before transfer to the paper P has a negative charge whose amount is slightly greater than zero, and therefore that for a maximum transfer efficiency, the amount of charge supplied from the transfer power supply must be made slightly smaller than the amount of charge that the toner T has.

Figure 5:
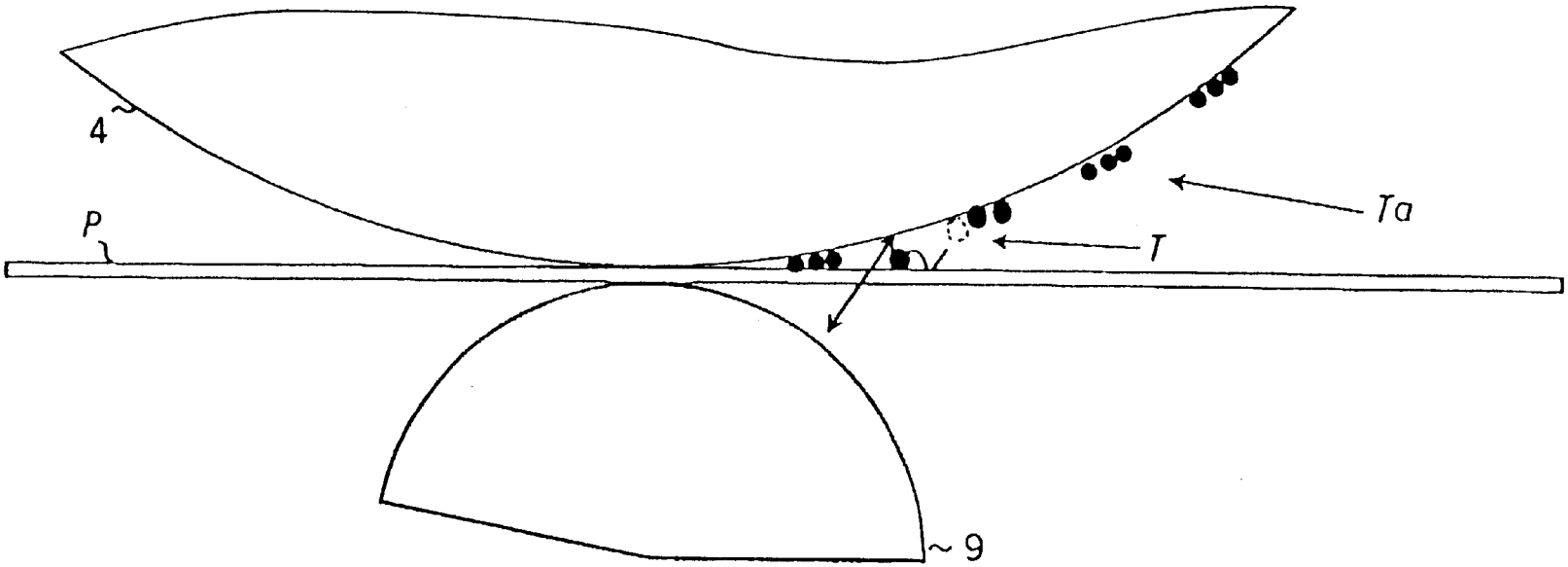
FIG. 5 is an explanatory diagram showing how toner is transferred in a transfer area in FIG. 1.

On the other hand, if the transfer is to be performed without neutralizing the charge possessed by the toner T, an electric field strong enough to overcome the image force must be formed, and in this case, an extremely large transfer electric field is required. When such a large electric field is formed, since the amount of charge of the toner T held to the photoconductor drum 4 is not constant but varies across the surface of the photoconductor drum 4, particles of the toner T that have smaller amounts of charge are caused by the electric field to separate from the photoconductor drum 4 and adhere to the paper P on the upstream side of the transfer area, as shown in FIG. 5; this separation of the toner T causes image formation problems such as toner scattering and smearing of the toner image.

In the first embodiment, for example, when transferring the toner T to the paper P as described above, a voltage of 1.3 kV is applied and a transfer current of about 6 $\mu$A is supplied from the transfer power supply to the transfer roller 9.

In the first embodiment, since nip width is 3 mm and nip length is about 22 cm, the amount of charge possessed by the toner T passing the nip area is $Q1=(-10\times10^{-6})\times(1\times10^{-3})\times22\times0.3=-6.6\times10^{-8}$ (C).

On the other hand, since the transportation speed of the paper P is 30 mm/sec, the amount of charge supplied from the transfer power supply is $Q2=(6\times10^{-6})\times0.3/30=6\times(10\times$ $10^{-8}$) (C); thus, Q1 is slightly larger than Q2. Accordingly, the amount of charge of the toner T in the transfer section retains the negative polarity and is slightly larger than zero (i.e., at $0.6\times10^{-8}$), achieving the greatest transfer efficiency and ensuring a good transfer.

In this way, when the amount of charge to be supplied to the paper P in the transfer section is made slightly smaller than the amount of charge that the toner T has, a good transfer can be achieved by neutralizing the amount of charge that the toner T has. Furthermore, according to the invention, since the transfer is performed by neutralizing the amount of charge that the toner T has and thereby reducing the image force, as described above, the required transfer electric field can be reduced in strength, obviating the need to supply a high power from the transfer power supply and achieving reductions in the size and the number of components of the power supply while enhancing the reliability.

In the first embodiment, the transfer roller 9 as the transfer means is constructed to supply charge to neutralize the charge of the toner T, but instead, a separate charge supply means may be provided to neutralize the charge of the toner T; however, supplying the charge using the transfer roller 9, as in the first embodiment, is more advantageous from the viewpoint of efficiency, and serves to reduce the size and the number of components of the apparatus and enhance the reliability since separate charge supply means is not required.

Further, in the first embodiment, the charge is neutralized while retaining the polarity of the charge of the toner T. On the other hand, if the charge neutralization is performed by reversing the polarity of the charge, that is, if the polarity of the charge of the toner T is reversed, since the charge of the toner T takes on the polarity opposite from its designated charge polarity, the charge characteristic tends to become unstable, so does the distribution of the amount of charge, leading, for example, to the formation within the toner layer of areas exhibiting a charge polarity opposite from the designated charge polarity, and resulting in areas where the toner is well transferred and areas where the toner is not well transferred.

For example, in the first embodiment, negatively charged toner is used, and the toner is neutralized while retaining the negative polarity. When the toner is made to retain its designated charge polarity after the neutralization, as described, the charge characteristic of the toner is very stable.

However, if charge is further supplied in this condition, the toner will presumably take on a positive charge. In this case, since the toner is charged with a polarity opposite from its designated charge polarity, its charge characteristic becomes very unstable. Surely, certain parts exhibit the intended positive polarity, but others remain negatively charged, and so the distribution of its charge amount becomes extremely uneven and does not stabilize. If transfer is performed in this condition, some areas are transferred but others are not, depending on the polarity of the toner, which thus causes dropouts, spots, and other problems degrading the image quality.

In this way, there are cases where toner usually exhibits good charge characteristics when charged with one polarity but very unstable charge characteristics when oppositely charged. In such cases, it is preferable to neutralize the charge while retaining its designated charge polarity, as practiced in the first embodiment.

Next, a second embodiment, which concerns a color image forming apparatus, will be described with reference to FIG. 6.

While the first embodiment has dealt with a monochrome image forming apparatus, the invention is also applicable to a color image forming apparatus. In the second embodiment, a tandem-type color image forming apparatus is constructed by arranging a plurality of image forming sections 8*a* to 8*d* in parallel, each constituting an image forming section, and using color toners, for example, of yellow, magenta, cyan, and black, for the respective image forming sections 8*a* to 8*d*. In FIG. 6, transfer rollers 9*a* to 9*d* to which the invention is applied are disposed opposite the respective image forming sections 8*a* to 8*d* of yellow, magenta, cyan, and black, and color image formation is performed based on image data of the respective colors.

Figure 6:
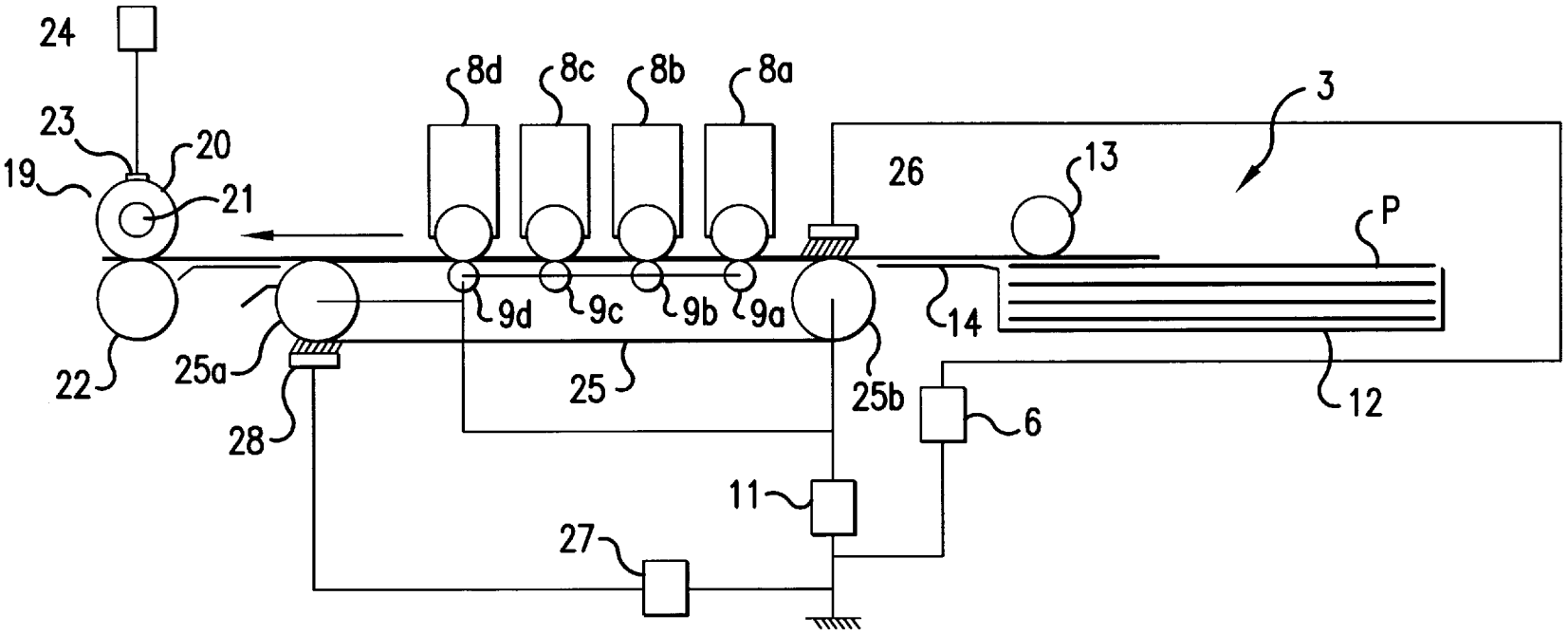
FIG. 6 is an explanatory diagram showing schematically a second embodiment concerning a color image forming apparatus using the transfer apparatus of the present invention.

In FIG. 6, paper P is electrostatically held onto a dielectric belt 25 and, in this condition, transported to the area where the developer units 8 and the transfer rollers 9*a* to 9*d* for the formation of a color image oppose. The dielectric belt 25 is run over a driving roller 25*a* and a driven roller 25*b*. An electrostatic charge is applied to the surface of the paper P by the potential difference between the potential of the driven roller 25*b* and the potential applied by the charge power supply 6 to a charge brush 26. This electrostatic charge causes the paper P to electrostatically adhere to the dielectric belt 25, and the paper P is conveyed as the dielectric belt 25 moves with the rotation of the driving roller 25*a*.

After all images have been transferred to the paper P, the paper P is separated from the dielectric belt 25 because of the curvature of the driving roller 25*a*, and transported to the fixing section 19 where the image is fixed by heating or by pressure.

After that, the surface of the dielectric belt 25 is discharged by a discharge brush 28 supplied with a discharge potential from a charge eliminating power supply 27.

Here, a belt having an elastic layer may be used as the dielectric belt 25.

Next, a third embodiment, which also concerns a color image forming apparatus, will be described with reference to FIG. 7.

In the third embodiment, developer units 8*a*–8*d* containing one of four color toners of yellow, cyan, magenta, and black, respectively, are arranged around the photoconductor drum 4. In the color image forming apparatus of the third embodiment, a charge roller 29 charges the paper P to a level sufficient to cause the paper P to electrostatically adhere to a drum 30 having an elastic layer on its surface, and the paper P is conveyed by being electrostatically held on the rotating drum 30. When the paper P reaches the area where the transfer roller 9 and the photoconductor drum 4 oppose each other, images on the photoconductor drum 4 are sequentially transferred to the paper P; the drum makes the necessary number of revolutions, i.e., four revolutions one for each of the four color toners, to complete the formation of the color image, and after that, the paper P is separated and fed to the fixing section 19 where the image is permanently fixed to the paper P.

In the case of a color image forming apparatus such as described in the second or third embodiment, that is, when using toners of different kinds, the different kinds of toners have different properties. It is therefore reasonable to determine suitable transfer conditions for each kind of toner, for example, for the respective transfer sections corresponding to the respective kinds of toners, and to perform control so that the desired transfer can be performed.

According to this control method, it is not desirable to make the transfer conditions the same for all the image forming sections, but for example, in the case of the color image forming apparatus of the second embodiment shown in FIG. 6, a transfer voltage of 1.3 kV is applied to the transfer roller 9*a* disposed opposite the image forming section 8*a*, while a transfer voltage of 1.4 kV is applied to the other rollers 9*b* to 9*d*.

In this way, the transfer voltage may be made different among the plurality of transfer sections (image forming sections). Further, the hardness, thickness, resistance, or dielectric constant of the elastic layer of the transfer roller, and further the contact pressure of the transfer roller, may be made different among the different transfer sections (image forming sections); doing so is not unreasonable from the point of view of making the best use of the properties of the toners used in the respective image forming sections 8*a* to 8*d*, and rather, it is desirable to vary the structure and the applied voltage according to the respective toners, transfer conditions, etc.

Figure 7:
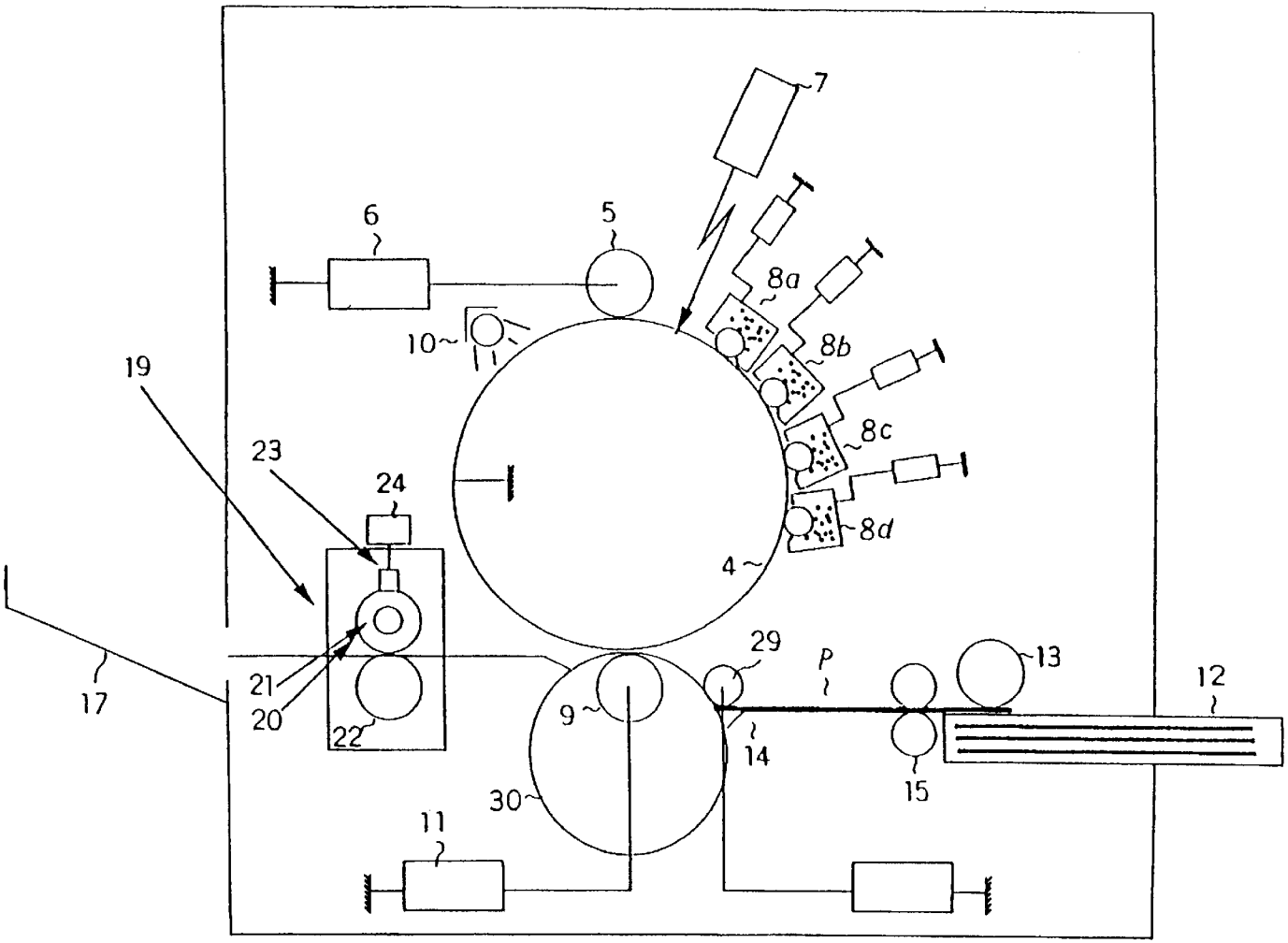
FIG. 7 is an explanatory diagram showing schematically a third embodiment concerning a color image forming apparatus using the transfer apparatus of the present invention.

Further, in the case of the color image forming apparatus of the third embodiment shown in FIG. 7, in the transfer process performed during the first and second revolutions it is desirable to vary, for example, the applied voltage conditions according to the properties of the toners to be transferred; by so doing, good image formation can be achieved since the desired transfer characteristics can be obtained without impairing the properties of the respective color toners.

On the other hand, when the color toners used are very similar in their properties, or when a sufficient margin can be allowed for the voltage used for the desired control, or for the structure of the transfer roller, etc., all or part of the transfer conditions or the structure of the transfer roller are made the same for the image forming sections corresponding to the respective colors. It is desirable that control be performed so that all or part of the transfer conditions such as the transfer voltage can be made the same; in that case, the size and the number of components of the power supplies or transfer rollers used can be reduced, thus reducing the cost while increasing the reliability.

The second and third embodiments have dealt with the construction that transfers toner images directly to the paper P, but the invention is not limited to this particular construction; for example, the invention can also be applied very effectively when employing an indirect transfer system that uses an intermediate transfer medium, for example, when transferring toner images from the photoconductor drum to the intermediate transfer medium or from the intermediate transfer medium to plain paper or the like.

Though the embodiments have been described by taking an example in which the toner is used as the developer, ink or the like may be used as the developer. Furthermore, the construction may be adapted so that the steps up to the electrostatic latent image formation are performed using the ion flow process. That is, the image forming section may be constructed to include an ion source such as a corona charger. In that case also, the same effects and advantages achieved with the above embodiments can be obtained. It will further be noted that the image forming apparatus according to the present invention can be advantageously applied to print sections in digital copiers and facsimile machines as well as to digital printers, plotters, etc.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A transfer apparatus comprising:

an image carrier for holding thereon an image formed by a developer charged with a negative polarity;

a transfer roller disposed opposite the image carrier;

a recording medium fed to an area where the image carrier and the transfer roller face each other, wherein a developer image on the image carrier is transferred to the recording medium by using a unidirectional transfer electric field applied from the transfer roller; and a supply means for supplying a charge to the developer held on the image carrier, said charge substantially neutralizing the negative charge of the developer while retaining the negative polarity of the developer.

2. The transfer apparatus of claim 1, wherein the charge supply means is implemented in common with the transfer roller.

3. The transfer apparatus of claim 1, wherein during transfer, the charge supply means supplies a smaller amount of charge of opposite polarity than the amount of negative charge held by the developer on the image carrier to substantially neutralize the negative charge of the developer while maintaining the prescribed negative polarity of the developer.

4. A transfer apparatus comprising:

an image carrier for holding thereon an image formed by a plurality of color developers each charged with a negative polarity;

a transfer roller disposed opposite the image carrier;

recording medium fed to an area where the image carrier and the transfer roller face each other, wherein a developer image on the image carrier is transferred to the recording medium by using a unidirectional transfer electric field applied from the transfer roller; and a charge supply means for supplying a plurality of respective charge amounts appropriate to each of the plurality of color developers held on the image carrier, said plurality of respective charge amounts each substantially neutralizing the negative charge of an associated one of the plurality of color developers while retaining the negative polarity of each of the plurality of color developers.

5. The transfer apparatus of claim 4, wherein the charge supply means is implemented in common with the transfer roller.

6. The transfer apparatus of claim 4, wherein during transfer, the charge supply means supplies a smaller amount of charge of opposite polarity than the amount of negative charge held by each of the plurality of color developers on the image carrier to substantially neutralize the charge of each of the plurality of color developers while maintaining the negative polarity of each of the plurality of color developers.

7. A method for transferring a developer image to a recording medium, the method comprising:

transferring a first negatively-charged toner image onto a photoconductive drum;

reducing an amount of negative charge in the first negatively-charged toner image to form a second negatively-charged toner image, the second negatively-charged toner image having a substantially reduced amount of negative charge contained therein with respect to the first negatively-charged toner image;

maintaining a negative polarity of the second negatively-charged toner image; and transferring the second negatively-charged toner image onto the recording medium.

8. The method of claim 7, wherein said step of transferring a first negatively-charged toner image onto the photoconductive drum further includes transferring a first plurality of negatively charged toner images onto the photoconductive drum, each of the first plurality of negatively charged toner images having a different color assigned thereto, said step of reducing an amount of negative charge in the first negatively-charged toner image to form a second negatively-charged toner image further including reducing an amount of negative charge in each of the first plurality of negatively charged toner images to form a second plurality of negatively-charged toner images, the second negatively-charged toner images each having a substantially reduced amount of negative charge contained therein with respect to a corresponding one of the first plurality of negatively-charged toner images, said step of maintaining a negative polarity of the second negatively-charged toner image further including maintaining a negative polarity of each of the second plurality of negatively-charged toner images, and said step of transferring the second negatively-charged toner image onto the recording medium further including transferring the second plurality of negatively-charged toner images onto the recording medium to record a color image.

9. The method of claim 7, wherein said step of reducing an amount of negative charge in the first negatively-charged toner image to form a second negatively-charged toner image is accomplished concurrently with said step of transferring the second negatively-charged toner image onto the recording medium.

10. The transfer apparatus of claim 1, wherein said charge supply means substantially neutralizes the charge of the developer held on the image carrier while maintaining the negative polarity of the developer, said charge supply means providing a neutralizing charge in an amount sufficient to establish a resulting developer net charge magnitude slightly greater than a zero charge magnitude.

11. The transfer apparatus of claim 4, wherein said each of the plurality of color developers has a respective color developer net negative charge having a magnitude slightly greater than a zero charge magnitude.

* * * * *